US005320712A

United States Patent [19]

Sawayama et al.

[11] Patent Number: 5,320,712

[45] Date of Patent: Jun. 14, 1994

[54] METHOD FOR SIZING OF PAPER

[75] Inventors: Shigeru Sawayama, Yokohama; Masato Nakajima, Hirakata, both of Japan

[73] Assignee: Mitsubishi Kasei Corporation, Tokyo, Japan

[21] Appl. No.: 892,434

[22] Filed: Jun. 1, 1992

Related U.S. Application Data

[63] Continuation of Ser. No. 687,461, Apr. 18, 1991, abandoned.

[30] Foreign Application Priority Data

Apr. 25, 1990 [JP] Japan ..... 2-109445

[51] Int. Cl.[5] ..... D21H 21/16

[52] U.S. Cl. ..... 162/168.2; 162/147; 162/168.3; 162/180; 162/181.2; 162/183

[58] Field of Search ..... 162/180, 181.2, 168.2, 162/168.3, 147, 183

[56] References Cited

U.S. PATENT DOCUMENTS

| | | | |
|---|---|---|---|
| 4,421,602 | 12/1983 | Brunnmueller . | |
| 4,784,727 | 11/1988 | Schroer et al. | 162/168.2 |
| 4,808,683 | 2/1989 | Itagaki . | |
| 4,824,913 | 4/1989 | Murao . | |
| 4,842,691 | 6/1989 | Nakajima et al. | 162/180 |
| 4,957,977 | 9/1990 | Itagaki . | |

FOREIGN PATENT DOCUMENTS

0251182A1 1/1988 European Pat. Off. ..... 226/2

OTHER PUBLICATIONS

Database Paperchem, Institute of Paper Chemistry & JP-A-78014807 (Arakawa Forest) Sep. 2, 1978 "The Entire Abstract".

*Primary Examiner*—Peter Chin

*Attorney, Agent, or Firm*—David G. Conlin; Ernest V. Linek

[57] ABSTRACT

The present invention relates to a method for sizing of paper by using a particular vinylamine polymer as a size-fixing aid. By the use of the vinylamine polymer as a size-fixing aid, it has become possible to obtain a paper having superior sizing properties by papermaking at a pH around neutrality using a hitherto known acidic sizing agents without using a neutral sizing agent. The method of the present invention further has effects that operating efficiency of papermaking is greatly improved since contaminations of a papermaking machine due to a neutral agent can be avoided, and therefore, the prices of paper can be greatly lowered. The present method has further advantages when it is applied under acidic papermaking condition of a pH of less than 5.5. In such a condition, the addition amount of alum can be decreased and the life of a papermaking machine can be prolonged. In spite of a small amount of alum added, a considerably good sizing effect can be obtained by the present method.

2 Claims, No Drawings

METHOD FOR SIZING OF PAPER

This is a continuation of copending application Ser. No. 07/687,461 filed on Apr. 18, 1991 now abandoned.

BACKGROUND OF THE INVENTION

The present invention relates to a novel method for the sizing of paper.

Hitherto, as the method for the sizing of paper, there have mainly been used the so-called acidic sizing methods in which acidic sizing agents such as rosin sizing agents, synthetic sizing agents, etc. and alum are employed. In recent years, the so-called neutral sizing methods in which neutral sizing agents represented by alkyl ketene dimer and alkenylsuccinic anhydride are employed have been developed in order to overcome the defects caused by alum in the acidic sizing methods or to use calcium carbonate, which is a low price filler. However, the neutral sizing methods are disadvantageous in the stability and the costs of the neutral sizing agents. Recently, in the manufacturing industry of the regenerated papers such as white boards, raw papers for gypsum boards and the like from wasted paper containing calcium carbonate, is required in order to meet the needs of conservation of resources a novel papermaking method which can provide papers showing an excellent sizing properties at a low cost by making a paper at around neutrality of pH range from 5.5 to 7.5.

As the acidic sizing methods using rosin sizing agents, there has been known a method disclosed in Japanese Patent Application Laid-Open (KOKAI) 14807/78 in which a paper with good sizing properties is obtained by using a particular Hofmann rearrangement-reaction product as a size-fixing aid. However, this method has defects in that size-fixing is insufficient in the papermaking at around neutrality.

SUMMARY OF THE INVENTION

It is the object of the present invention to provide a method for making a paper having an excellent sizing property by making a paper at a pH around neutrality using a known acidic sizing agent which is widely used in the art.

The present inventors have researched in order to solve the above problems in the prior art and have found that the problems can be solved by making a paper using a particular vinylamine polymer as a size-fixing aid. The present invention has been accomplished based on this finding.

DETAILED DESCRIPTION OF THE INVENTION

The present invention relates to a method for sizing of paper which comprises subjecting a mixture comprising an aqueous pulp slurry, an acidic sizing agent, alum and a size-fixing aid to papermaking at a pH value from 5.5 to 7.5, the size-fixing aid being a vinylamine polymer having the constitutional repeating units represented by the following formulae (I), (II) and (III):

$$-CH_2-\underset{\underset{NH_3X}{|}}{CH}- \quad \text{(I)}$$

$$-CH_2-\underset{\underset{NHCHO}{|}}{CH}- \quad \text{(II)}$$

-continued $$-CH_2-\underset{\underset{Y}{|}}{CR_1}- \quad \text{(III)}$$

wherein X represents an anion, $R_1$ represents a hydrogen atom or a methyl group, and Y represents at least one functional group selected from the group consisting of a cyano group, a carbamoyl group which may be substituted, a carboxyl group and a ($C_1$–$C_4$ alkoxy)carbonyl group, the mol fraction of the unit (I) being 5 to 95 mol %, the mol fraction of the unit (II) being 2 to 95 mol %, and the mol fraction of the unit (III) being 0 to 90 mol %, with the proviso that the mol fraction of the unit (III) is less than the mol fraction of the unit (I) when Y is a carboxyl group.

A vinylamine polymer in which the mol fraction of the unit (I) is 5 to 95 mol %, the mol fraction of the unit (II) is 5 to 95 mol % and the mol fraction of the unit (III) is 0 to 80 mol % is more preferred to be used as the size-fixing aid in the present invention.

The vinylamine polymer used in the present invention may be easily obtained by modifying formyl groups in an N-vinylformamide polymer (homopolymer and copolymer) under acidic or basic conditions. The homopolymer of N-vinylformamide as a starting material is prepared by polymerizing N-vinylformamide in the presence of a radical polymerization initiator. The copolymer of N-vinylformamide as a starting material is prepared by polymerizing in the presence of a radical polymerization initiator a monomer mixture comprising 10 mol % or more, preferably 20 mol % or more, of N-vinylformamide and a compound represented by the following formula (IV):

$$CH_2=\underset{\underset{Y}{|}}{CR_1} \quad \text{(IV)}$$

wherein $R_1$ represents a hydrogen atom or a methyl group, Y represents at least one functional group selected from the group consisting of a cyano group, a carbamoyl group which may be substituted, a carboxyl group and a ($C_1$–$C_4$ alkoxy)carbonyl group. The preferred compound of the formula (IV) may include acrylonitrile, $C_1$–$C_4$ alkyl (meth)acrylates, acrylamide and (meth)acrylic acid, and acrylonitrile and acrylamide are most preferable.

As a polymerization method for producing the N-vinylformamide polymer, a bulk polymerization, a solution polymerization using various solvents and a precipitation polymerization process using various solvents may be adopted. Among these methods, a polymerization method using water as a polymerization solvent is preferable. In polymerizing a monomer by a solution polymerization method, the concentration of monomer, the polymerization method and the shape of a polymerization vessel are appropriately selected in consideration of the molecular weight of the polymer to be produced and of the polymerization heats to be evolved.

For example, when water is used as a polymerization solvent, the N-vinylformamide polymer can be produced by a method in which the polymerization is initiated in a solution form at a monomer concentration of 5 to 20 weight % to produce a polymer in a solution form; a method in which the polymerization is initiated at a monomer concentration of 20 to 60 weight % to produce a polymer as a wet gel-like product or as a polymer precipitate; a method in which an aqueous solution of a monomer concentration of 20 to 60 weight % is subjected to polymerization in water-in-oil or oil-in-water emulsion state by using a hydrophobic solvent and an emulsifying agent; or a method in which an aqueous monomer solution of a monomer concentration of 20 to 60 weight % is subjected to polymerization in a water-in oil dispersion state by the use of a hydrophobic solvent and a dispersion stabilizer. In copolymerization with acrylonitrile, the N-vinylformamide polymer may be obtained as a precipitated product in water.

As the radical polymerization initiator, there may be employed any of usual initiators used for the polymerization of a water-soluble or hydrophilic monomer. For obtaining the polymer in a higher yield, azo compounds are preferable, and water-soluble azo compounds are more preferable. For example, there are used hydrochloride or acetate of 2,2'-azobis-2-amidinopropane, sodium salt of 4,4'-azobis-4-cyanovaleric acid, and hydrochloride or acetate of azobis-N,N'-dimethyleneisobutylamidine. The polymerization initiator is usually used in an amount from 0.01 to 1% by weight based on the weight of the monomer. The polymerization reaction is carried out at a temperature of 30° to 100° C. under an inert gas stream.

The N-vinylformamide polymer obtained as described above is modified under acidic or basic conditions to obtain the vinylamine polymer in solution or dispersion directly after the polymerization followed or not followed by dilution. The modification can be carried out after separation of the N-vinylformamide polymer followed by removing water, drying and pulverizing by a known method.

However, when the N-vinylformamide polymer to be modified contains the units (III) wherein Y is a cyano group, a carbamoyl group or a alkoxycarbonyl group in a large amount, the modification under basic condition is not preferred. It is because in the basic hydrolysis of the formyl group in water, the cyano group, carbamoyl group and alkoxycarbonyl group are also hydrolysed to form a large excess of carboxyl groups, thereby resulting in the production of an insoluble polymer or the production of an ampholytic polymer containing a large number of anionic groups.

As a method for modifying the N-vinylformamide polymer, there are exemplified an acidic or basic hydrolysis in water, an acidic or basic hydrolysis in a water-containing hydrophilic solvent such as alcohol, and a method in which the formyl group is subjected to alcoholysis and the modification is carried out under separating the resulting formic ester from the system. Alcohols having 1 to 4 carbon atoms, preferably methanol, may be used in the alcoholysis.

As the modifying agent used in the acidic modification, there may be used any of the compounds acting as a strong acid, for example, hydrochloric acid, bromic acid, hydrofluoric acid, sulfuric acid, nitric acid, phosphoric acid, sulfamic acid, alkanesulfonic acids, and the like. As the modifying agent used in the basic modification, there may be used any of the compounds acting as a strong base in water, for example, sodium hydroxide, potassium hydroxide, quaternary ammonium hydroxides and the like.

The modifying agent is used in an amount appropriately selected from the range from 0.1 to 2 mol per one mol of the formyl group in the N-vinylformamide polymer depending upon the intended extent of the modification.

As the result of the modification, X in the unit (I) of the vinylamine polymer represents an acid radical such as halogen ion, sulfate ion, etc. corresponding to the acid used as the modifying agent in the case of the acidic modification, and X represents hydroxyl ion in the case of the basic modification.

The modification is carried out at a temperature from 10° to 100° C. The molecular weight of the vinylamine polymer is not otherwise limited, but usually the reduced viscosity of the vinylamine polymer is 0.1 to 10 dl/g, preferably 0.5 to 10 dl/g, the reduced viscosity being measured at 25° C. on a 0.1 g/dl solution in 1N-brine. When the reduced viscosity is less than 0.1 dl/g, the size-fixing properties tends to be decreased. When the reduced viscosity exceeds 10 dl/g, the workability tends to become lower owing to the high viscosity.

The vinylamine polymer obtained by the above process is used as a size-fixing aid in accordance with the following method, and it imparts a superior sizing effect to a produced paper.

The acidic sizing agent used in the present invention is not otherwise limited, and may include any of various known sizing agents, for example, rosin sizing agents and synthetic sizing agents. The rosin sizing agent may include one in which rosin substance is dissolved or dispersed in water by an appropriate means, and it may include an aqueous solution-type rosin sizing agent neutralized with alkali and an emulsion-type rosin sizing agent emulsified with various surface active agents or with water-soluble polymers. The rosin substance may include rosins such as gum rosin, wood rosin, tall oil rosin, hydrogenated rosin, disproportioned rosin, polymerized rosin, aldehyde-modified rosin and rosin ester, and reaction product of the rosin recited above and an $\alpha,\beta$-unsaturated carboxylic acid such as acrylic acid, maleic anhydride, fumaric acid itaconic acid and the like.

The surface active agent or water-soluble polymer used in the emulsion-type rosin sizing agent may include a rosin substance neutralized with alkali, a salt of alkylbenzenesulfonic acid, a monoalkyl sulfate, polyethylene glycol, a polyoxyethylene alkyl ether, a polyoxyethylene alkyl phenyl ether, a polyoxyethylene alkyl ether sulfate salt, a polyoxyethylene alkyl ether sulfonate salt, a polyoxyethylene alkyl ether sulfosuccinate salt, polyvinyl alcohol, polyacrylamide, a copolymer of a hydrophobic monomer such as styrene compound, lower alkyl (meth)acrylates, etc. and an anionic monomer such as (meth)acrylic acid, etc., shellac, casein, and the like.

The synthetic sizing agent may include a reaction product of an olefin having 8 to 20 carbon atoms and an $\alpha,\beta$-unsaturated carboxylic acid. The olefin having 8 to 20 carbon atoms may include octene, dodecene, tetradecene, octadecene, and the like. The $\alpha,\beta$-unsaturated carboxylic acid may include acrylic acid, methacrylic acid, maleic anhydride, fumaric acid, itaconic acid and the like. The typical example of the reaction product is a water-soluble salt of a substituted succinic acid, more precisely, a water-soluble salt of an alkenylsuccinic anhydride such as octenyl succinic anhydride, dodecenyl succinic anhydride, and the like. The synthetic sizing agents are described in more detail in Japanese Patent Publication (KOKOKU) No. 565/65.

In practical application of the paper sizing method of the present invention, the various known processes are adopted except for adjusting the pH to the specific range and using the vinylamine polymer as a size-fixing aid in papermaking process. For example, to an aqueous pulp slurry, are added 0.05 to 2% by weight (based on pulp solid) of an acidic sizing agent, 0.1 to 5% by weight (based on pulp solid) of alum and 0.005 to 0.5% by weight of the vinylamine polymer as a size-fixing aid, and then the conventional papermaking method is applied while adjusting the pH to the range from 5.5 to 7.5. The order of the addition is not otherwise limited. Usually, a sizing agent and alum are added to a pulp slurry, and then a size-fixing aid is added thereto. The kinds of pulps are not particularly limited, and various known pulps may be used optionally. Pulps may include ground pulp, semi-ground pulp, sulfite pulp, semi-chemical pulp, kraft pulp, as well as regenerated pulps prepared by defibering wasted papers. The above pulps are used along or in combination.

Since the paper sizing method of the present invention is carried out at around neutrality, it is usual that the pH of the papermaking system is adjusted by appropriately selecting the amount of alum and the amount of an alkaline filler such as calcium carbonate. As described above, wasted papers containing calcium carbonate may be used as the starting pulp in the paper sizing method of the present invention, and the use of such wasted paper is advantageous in view of the paper production costs and conservation of resources. The type of calcium carbonates are not otherwise limited, and it may include various known calcium carbonates such as ground calcium carbonate, precipitated calcium carbonate and the like. Such calcium carbonate may be contained in the starting pulp in an amount not higher than 30 weight %.

Hereinafter, the present invention will be described in more detail by Production Examples, Examples and Comparative Examples. However, it should be noted that the present invention is not limited by these Examples.

Production Example 1

A reaction vessel equipped with a stirrer, a nitrogen inlet tube and a condenser was charged with 4.0 g of N-vinylformamide or 4.0 g of a respective monomer mixture listed in Table 1, and 35.9 g of desalted water. The content was heated to 60° C. with stirring under a nitrogen stream, and was added with 0.12 g of an aqueous 10% (by weight) solution of 2,2'-azobis-2-amidinopropane dihydrochloride. The content was held at 60° C. for 3 hours under stirring to obtain a polymer. The unreacted monomer or monomers remaining in water was measured by liquid chromatograph or gas chromatograph to determine the composition of the obtained polymer.

The obtained polymer was added with conc. hydrochloric acid in an amount equivalent to the formyl groups in the polymer, and was maintained at 75° C. for 8 hours under stirring to hydrolyse the polymer.

The obtained polymer solution was added into acetone to form a precipitate. After vacuum drying the precipitated polymer, a vinylamine polymer was obtained in a solid form. The mol fraction of the compound (IV) in the monomer mixture, colloid equivalent, the result of elemental analysis, the mol fraction of the constitutional units in the obtained vinylamine polymer determined by $^{13}$C-NMR spectrum, and reduced viscosity of the obtained vinylamine polymer are shown in Table 1.

The colloid equivalent and reduced viscosity were measured by the methods described hereinafter.

Colloid equivalent

A solid polymer was dissolved in distilled water to prepare a 0.1 weight % aqueous polymer solution. 5.0 g of the aqueous polymer solution was diluted to 200 ml with deionized water, then adjusted to pH 3 with dil. hydrochloric acid. The colloid equivalent was determined by colloid titration method using 1/400N potassium polyvinyl sulfate and using toluidine blue as an indicator.

Reduced viscosity

A solid polymer is dissolved in 1N-brine to prepare a polymer solution of a concentration of 0.1 g/dl. The reduced viscosity was measured at 25° C. by using a Ostwald viscometer.

$$\text{Reduced viscosity } (dl/g) = (t - t_0)/t_0/0.1$$

$t_0$: falling speed of brine
t: falling speed of polymer solution

TABLE 1

| Vinylamine polymer | Mol fraction of the compound (IV) in the monomer mixture | Mol fraction of the units in vinylamine polymer (mol %) I | II | III $R_1$ Y | III $R_1 = H$ $Y = CONH_2$ | Reduced viscosity (dl/g) |
|---|---|---|---|---|---|---|
| A | 0 | 56 | 44 | 0 | 0 | 0.5 |
| B | 0 | 50 | 50 | 0 | 0 | 2.9 |
| C | 0 | 50 | 50 | 0 | 0 | 4.3 |
| D | 0 | 48 | 52 | 0 | 0 | 5.5 |
| E | 0 | 52 | 48 | 0 | 0 | 6.1 |
| F | 0 | 6 | 94 | 0 | 0 | 5.9 |
| G | 0 | 21 | 79 | 0 | 0 | 4.9 |
| H | 0 | 31 | 69 | 0 | 0 | 4.4 |
| I | 0 | 78 | 22 | 0 | 0 | 3.9 |
| J | 0 | 95 | 5 | 0 | 0 | 3.6 |
| K | AN 0.8 | 16 | 4 | 61*1 | 19 | 2.9 |
| L | AN 0.5 | 40 | 10 | 38*1 | 12 | 2.6 |
| M | MMA 0.1 | 61 | 29 | 10*2 | 0 | 2.5 |

TABLE 1-continued

| Vinylamine polymer | Mol fraction of the compound (IV) in the monomer mixture | Mol fraction of the units in vinylamine polymer (mol %) I | II | III $R_1$ Y | III $R_1 = H$ $Y = CONH_2$ | Reduced viscosity (dl/g) |
|---|---|---|---|---|---|---|
| N | DAA 0.2 | 64 | 16 | 20*3 | 0 | 3.0 |

Note:
AN: acrylonitrile, MMA: methyl methacrylate, DAA: diacetone acrylamide
*1 $R_1 = H$, $Y = CN$
*2 $R_1 = CH_3$, $Y = COOCH_3$
*3 $R_1 = H$, $Y = CONHC(CH_3)_2CH_2COCH_3$

EXAMPLES 1-14

A predetermined amount of alum was added to 1 weight % slurry of pulp (L-BKP, Canadian Standard Freeness of 485 ml), and was agitated for 5 min.

A rosin emulsion sizing agent (trade name: Sizepine N-705, manufactured by Arakawa Kagaku Kogyo Co.) was added thereto in an amount of 0.2% by weight (as solid) based on pulp, and further agitated for 5 min. Then, respective vinylamine polymer (polymers A-N described in Table 1) as size-fixing aid was added thereto in an amount described in Table 2 and further agitated for 5 min. Using each of pulp slurries, each of sheets of paper was made at a pH value described in Table 2 by means of a TAPPI Standard Sheet Machine. The formed wet paper was dehydrated under a pressure of 3.5 kg/cm$^2$, and dried at 100° C. for 1 min. The dried paper was conditioned at 20° C. and at 65% RH for at least 24 hours, the Stöckigt sizing degree thereof was tested in accordance with the method described in Japanese Industrial Standard (JIS) P 8122.

The results are shown in Table 2. As seen from the results in Table 2, the present method shows excellent results irrespective of pH values. Especially, the superiority of the present method to the methods in Comparative Examples 1 to 3 is remarkable in the pH range of 5.5 to 7.5.

COMPARATIVE EXAMPLE 1

A dried paper was produced in the same manner as in Example 1 except that a Hofmann rearrangement product (a) of polyacrylamide (produced by subjecting a polyacrylamide of a molecular weight of 300,000 to Hofmann rearrangement to change 20 mol % of the acrylamide units into the vinylamine units) was used as a size-fixing aid. The results are shown in Table 2.

COMPARATIVE EXAMPLE 2

A paper was produced in the same manner as in Example 1 except that a copolymer (b) (reduced viscosity: 1.2 dl/g) of acrylamide and dimethylaminopropylmethacrylamide (mol ratio: 95/5) was used as a size-fixing aid. The results are shown in Table 2.

COMPARATIVE EXAMPLE 3

A paper was produced in the same manner as in Example 1 except that no size-fixing aid was used. The results are shown in Table 2.

EXAMPLES 15-32

To 1 weight % pulp slurry (L-BKP, Canadian Standard Freeness: 450 mol), were added calcium carbonate in an amount of 2% by weight (as solid) based on pulp, then was agitated for 5 min. After the agitation, was added further alum in an amount of 0.5% by weight based on pulp and was agitated for additional 5 min. Finally, each of size-fixing aids was added thereto in an amount described in Table 3 and was agitated for 5 min. Using the obtained pulp slurry, each of papers was formed at pH of 7.2 by means of TAPPI Standard Sheet Machine. The resultant wet paper was dehydrated under a pressure of 3.5 kg/cm$^2$, and was dried at 100° C. for 1 min. Each of dried papers was conditioned at 20° C. and at 65% RH for at least 24 hours and was tested for a Stöckigt sizing degree. The results are shown in Table 3.

(1) Aqueous type fortified rosin sizing agent (trade name Sizepine E, manufactured by Arakawa Kagaku Kogyo Co.)

(2) Alkenylsuccinate type sizing agent (trade name: Sizepine S-300, manufactured by Arakawa Kagaku Kogyo Co.)

(3) Rosin emulsion sizing agent (trade name: Sizepine N-705, manufactured by Arakawa Kagaku Kogyo Co.)

COMPARATIVE EXAMPLES 4-6

Each of papers was produced in the same manner as in Example 15 except that the Hofmann rearrangement product (a) was used as the size-fixing aid. The results are shown in Table 4.

COMPARATIVE EXAMPLES 7-9

Each of papers was produced in the same manner as in Example 15 except that the copolymer (b) was used as the size-fixing aid. The results are shown in Table 4.

COMPARATIVE EXAMPLES 10-12

Each of papers was produced in the same manner as in Example 15 except that no size-fixing aid was used. The results are shown in Table 4.

EXAMPLES 33-50

To 1 weight % pulp slurry (magazine wasted paper containing 4.5% by weight of calcium carbonate; Canadian Standard Freeness: 380 ml), each of the sizing agents listed in Table 5 was added in an amount of 0.5% by weight based on the pulp and was agitated for 5 min. Then alum was added thereto in an amount of 2.0% by weight based on the pulp and further agitated for 5 min. Finally each of size-fixing aids was added in an amount described in Table 5 and was agitated for 5 min. Each of papers was formed at pH of 6.9 by means of TAPPI Standard Sheet Machine. The resultant wet paper was dehydrated under a pressure of 3.5 kg/cm$^2$, and was dried for 1 min. at 100° C. Each of dried paper was conditioned at 20° C. and at 65% RH for at least 24 hours, and was tested for Stöckigt sizing degree. The results are shown in Table 5.

COMPARATIVE EXAMPLES 13–15

Each of papers was produced in the same manner as in Example 33 except that the Hofmann rearrangement product (a) was used as the size-fixing aid. The results are shown in Table 6.

COMPARATIVE EXAMPLES 16–18

Each of papers was produced in the same manner as in Example 33 except that the copolymer (b) was used as the size-fixing aid. The results are shown in Table 6.

COMPARATIVE EXAMPLES 19–21

Each of papers was produced in the same manner as in Example 33 except that no size-fixing aid was used. The results are shown in Table 6.

TABLE 2

Stöckigt sizing degree (sec) — Average basis weight: 60.5 g/m²

| | Size-fixing aid | Addition amount of size-fixing aid (%) | Alum addition amount (%) 2.0 | 1.0 | 0.5 |
|---|---|---|---|---|---|
| | | | pH 4.5 | 5.5 | 6.2 |
| Example 1 | A | 0.05 | — | — | 17.5 |
| | | 0.1 | 32.8 | 30.9 | 24.3 |
| | | 0.2 | — | — | 27.8 |
| Example 2 | B | 0.05 | — | — | 18.1 |
| | | 0.1 | 33.6 | 32.0 | 25.8 |
| | | 0.2 | — | — | 28.7 |
| Example 3 | C | 0.05 | — | — | 18.9 |
| | | 0.1 | 34.2 | 33.1 | 26.5 |
| | | 0.2 | — | — | 30.0 |
| Example 4 | D | 0.05 | — | — | 18.4 |
| | | 0.1 | 33.5 | 32.8 | 26.1 |
| | | 0.2 | — | — | 29.6 |
| Example 5 | E | 0.05 | — | — | 17.7 |
| | | 0.1 | 32.7 | 31.6 | 24.8 |
| | | 0.2 | — | — | 29.1 |
| Example 6 | F | 0.05 | — | — | 15.5 |
| | | 0.1 | 29.6 | 26.3 | 23.1 |
| | | 0.2 | — | — | 26.4 |
| Example 7 | G | 0.05 | — | — | 16.1 |
| | | 0.1 | 29.9 | 27.0 | 24.2 |
| | | 0.2 | — | — | 27.2 |
| Example 8 | H | 0.05 | — | — | 17.6 |
| | | 0.1 | 32.1 | 30.9 | 25.7 |
| | | 0.2 | — | — | 27.9 |
| Example 9 | I | 0.05 | — | — | 18.1 |
| | | 0.1 | 32.4 | 31.6 | 25.4 |
| | | 0.2 | — | — | 27.5 |
| Example 10 | J | 0.05 | — | — | 17.0 |
| | | 0.1 | 31.6 | 30.4 | 24.1 |
| | | 0.2 | — | — | 27.2 |
| Example 11 | K | 0.1 | 34.1 | 33.6 | 27.5 |
| Example 12 | L | 0.1 | 33.8 | 32.7 | 27.0 |
| Example 13 | M | 0.1 | 29.5 | 27.8 | 24.3 |
| Example 14 | N | 0.1 | 28.4 | 27.1 | 23.7 |
| Comparative Example 1 | a | 0.05 | — | — | 6.5 |
| | | 0.1 | 24.1 | 18.2 | 10.3 |
| | | 0.2 | — | — | 13.1 |
| Comparative Example 2 | b | 0.05 | — | — | 7.8 |
| | | 0.1 | 26.4 | 21.7 | 12.6 |
| | | 0.2 | — | — | 16.6 |
| Comparative Example 3 | None | 0 | 18.5 | 12.9 | 2.1 |

TABLE 3

Stöckigt sizing degree (sec) — Average basis weight: 60.5 g/m²

| Example | Size-fixing aid | Additon amount of size-fixing aid (%) | Sizing agent ① | ② | ③ |
|---|---|---|---|---|---|
| Example 15 | A | 0.05 | 18.2 | — | — |
| | | 0.1 | 21.5 | — | — |
| Example 16 | A | 0.05 | — | 17.4 | — |
| | | 0.1 | — | 20.9 | — |

TABLE 3-continued

Stöckigt sizing degree (sec) — Average basis weight: 60.5 g/m²

| Example | Size-fixing aid | Additon amount of size-fixing aid (%) | Sizing agent ① | ② | ③ |
|---|---|---|---|---|---|
| Example 17 | A | 0.05 | — | — | 24.8 |
| | | 0.1 | — | — | 28.6 |
| Example 18 | C | 0.05 | 19.5 | — | — |
| | | 0.1 | 22.2 | — | — |
| Example 19 | C | 0.05 | — | 18.8 | — |
| | | 0.1 | — | 22.0 | — |
| Example 20 | C | 0.05 | — | — | 25.1 |
| | | 0.1 | — | — | 29.3 |
| Example 21 | E | 0.05 | 18.9 | — | — |
| | | 0.1 | 21.8 | — | — |
| Example 22 | E | 0.05 | — | 17.9 | — |
| | | 0.1 | — | 21.3 | — |
| Example 23 | E | 0.05 | — | — | 25.0 |
| | | 0.1 | — | — | 28.2 |
| Example 24 | F | 0.05 | 16.4 | — | — |
| Example 25 | F | 0.05 | — | 15.2 | — |
| Example 26 | F | 0.05 | — | — | 23.5 |
| Example 27 | J | 0.05 | 17.7 | — | — |
| Example 28 | J | 0.05 | — | 17.1 | — |
| Example 29 | J | 0.05 | — | — | 24.4 |
| Example 30 | L | 0.05 | 19.8 | — | — |
| Example 31 | L | 0.05 | — | 18.6 | — |
| Example 32 | L | 0.05 | — | — | 25.6 |

TABLE 4

Stöckigt sizing degree (sec) — Average basis weight: 60.5 g/m²

| Example | Size-fixing aid | Additon amount of size-fixing aid (%) | Sizing agent ① | ② | ③ |
|---|---|---|---|---|---|
| Comparative Example 4 | a | 0.05 | 3.5 | — | — |
| | | 0.1 | 6.1 | — | — |
| Comparative Example 5 | a | 0.05 | — | 2.8 | — |
| | | 0.1 | — | 5.7 | — |
| Comparative Example 6 | a | 0.05 | — | — | 4.0 |
| | | 0.1 | — | — | 8.6 |
| Comparative Example 7 | b | 0.05 | 3.8 | — | — |
| | | 0.1 | 7.2 | — | — |
| Comparative Example 8 | b | 0.05 | — | 3.2 | — |
| | | 0.1 | — | 6.4 | — |
| Comparative Example 9 | b | 0.05 | — | — | 5.2 |
| | | 0.1 | — | — | 9.5 |
| Comparative Example 10 | None | 0 | 0 | — | — |
| Comparative Example 11 | None | 0 | — | 0 | — |
| Comparative Example 12 | None | 0 | — | — | 0 |

TABLE 5

Stöckigt sizing degree (sec) — Average basis weight: 62.5 g/m²

| Example | Size-fixing aid | Additon amount of size-fixing aid (%) | Sizing agent ① | ② | ③ |
|---|---|---|---|---|---|
| Example 33 | A | 0.05 | 12.4 | — | — |
| | | 0.1 | 16.5 | — | — |
| Example 34 | A | 0.05 | — | 11.1 | — |
| | | 0.1 | — | 15.9 | — |
| Example 35 | A | 0.05 | — | — | 13.6 |
| | | 0.1 | — | — | 17.5 |
| Example 36 | C | 0.05 | 12.8 | — | — |
| | | 0.1 | 17.0 | — | — |
| Example 37 | C | 0.05 | — | 11.5 | — |
| | | 0.1 | — | 16.3 | — |
| Example 38 | C | 0.05 | — | — | 13.9 |
| | | 0.1 | — | — | 18.0 |
| Example 39 | E | 0.05 | 12.6 | — | — |
| | | 0.1 | 16.3 | — | — |
| Example 40 | E | 0.05 | — | 11.2 | — |
| | | 0.1 | — | 16.1 | — |
| Example 41 | E | 0.05 | — | — | 13.5 |
| | | 0.1 | — | — | 17.8 |

TABLE 5-continued

| Stöckigt sizing degree (sec) | | Average basis weight: 62.5 g/m² | | | |
|---|---|---|---|---|---|
| Example | Size-fixing aid | Additon amount of size-fixing aid (%) | Sizing agent ① | ② | ③ |
| Example 42 | F | 0.05 | 10.4 | — | — |
| Example 43 | F | 0.05 | — | 9.8 | — |
| Example 44 | F | 0.05 | — | — | 11.5 |
| Example 45 | J | 0.05 | 11.5 | — | |
| Example 46 | J | 0.05 | — | 10.2 | — |
| Example 47 | J | 0.05 | — | — | 12.8 |
| Example 48 | L | 0.05 | 12.6 | — | — |
| Example 49 | L | 0.05 | — | 11.2 | — |
| Example 50 | L | 0.05 | — | — | 13.8 |

TABLE 6

| Stöckigt sizing degree (sec) | | Average basis weight: 62.5 g/m² | | | |
|---|---|---|---|---|---|
| Example | Size-fixing aid | Additon amount of size-fixing aid (%) | Sizing agent ① | ② | ③ |
| Comparative | a | 0.05 | 1.5 | — | — |
| Example 13 | | 0.1 | 3.1 | — | — |
| Comparative | a | 0.05 | — | 1.0 | — |
| Example 14 | | 0.1 | — | 2.8 | — |
| Comparative | a | 0.05 | — | — | 2.0 |
| Example 15 | | 0.1 | — | — | 4.3 |
| Comparative | b | 0.05 | 1.5 | — | — |
| Example 16 | | 0.1 | 3.5 | — | — |
| Comparative | b | 0.05 | — | 1.0 | — |
| Example 17 | | 0.1 | — | 3.0 | — |
| Comparative | b | 0.05 | — | — | 2.5 |
| Example 18 | | 0.1 | — | — | 4.5 |
| Comparative Example 19 | None | 0 | 0 | — | — |
| Comparative Example 20 | None | 0 | — | 0 | — |
| Comparative Example 21 | None | 0 | — | — | 0 |

What is claimed is:

1. A method for sizing paper which comprises subjecting a mixture comprising:

(a) an aqueous pulp slurry which contains a calcium carbonate type filler and/or a waste paper containing a calcium carbonate filler;

(b) an emulsion type rosin sizing agent containing no polyhydric alcohols, and prepared by dispersing in water a reaction product of a rosin and an alpha,-beta-unsaturated carboxylic acid;

(c) alum and (d) a size-fixing aid;

to papermaking at a pH value from 5.5 to 7.5, wherein the size-fixing aid consists of a vinylamine polymer having the constitutional repeating units represented by the following formulae (I), (II) and (III):

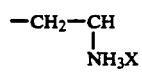

(I)

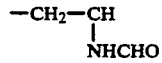

(II)

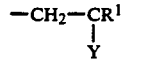

(III)

wherein X represents an anion, $R^1$ represents a hydrogen atom or a methyl group, and Y represents at least one functional group selected from the group consisting of a cyano group, a carbamoyl group which may be substituted, a carboxyl group and a ($C_1$–$C_4$ alkoxy)carbonyl group, and wherein the mol fraction of repeating unit (I) is from about 5 to 95 mol %, and the mol fraction of repeating unit (II) is being from about 2 to 95 mol %, and the mol fraction of repeating unit (III) is from 0 to about 90 mol % 1, with the proviso that the mol fraction of repeating unit (III) is less than the mol fraction of repeating unit (I) when Y is a carboxyl group.

2. The method according to claim 1, wherein said size-fixing aid has a reduced viscosity of 0.1 to 10 dl/g measured at 25° C. as a 0.1 g/dl solution in 1N brine.

* * * * *